United States Patent [19]

Stumpf et al.

[11] Patent Number: 5,004,202

[45] Date of Patent: Apr. 2, 1991

[54] BOOK END BRACKET AND SHELVING SYSTEM

[75] Inventors: William E. Stumpf, Minneapolis; Casey L. Carlson, Edina, both of Minn.; Richard S. Knape, Grand Rapids; Walter L. Bessinger, Grand Haven, both of Mich.

[73] Assignee: Knape & Vogt Manufacturing Company, Grand Rapids, Mich.

[21] Appl. No.: 381,122

[22] Filed: Jul. 14, 1989

[51] Int. Cl.[5] ..... A47G 29/02

[52] U.S. Cl. ..... 248/243; 108/108; 211/187; 248/250

[58] Field of Search ..... 248/235, 225.2, 241, 248/243, 247, 250; 108/108; 211/90, 187, 153, 186, 193

[56] References Cited

U.S. PATENT DOCUMENTS

| | | | |
|---|---|---|---|
| 1,201,703 | 10/1916 | Davidson | 248/243 X |
| 3,325,017 | 6/1967 | Tucker | 211/193 |
| 3,490,393 | 1/1970 | Nelson | 248/243 X |
| 3,765,344 | 10/1973 | Ferdinand | 248/243 X |
| 4,223,966 | 9/1980 | Winters | 211/187 X |
| 4,345,525 | 8/1982 | Poorter | 211/187 X |
| 4,444,321 | 4/1984 | Carlstrom | 248/235 X |
| 4,736,997 | 4/1988 | Besore | 108/108 X |

FOREIGN PATENT DOCUMENTS

| | | | |
|---|---|---|---|
| 80398 | 1/1956 | Denmark | 248/242 |
| 707694 | 4/1954 | United Kingdom | 108/108 |

*Primary Examiner*—J. Franklin Foss

*Attorney, Agent, or Firm*—Price, Heneveld, Cooper, DeWitt & Litton

[57] ABSTRACT

A shelving assembly having vertical standards and brackets thereon suspending shelves therebetween by telescopic mounting connectors telescopically fitted into and projecting from openings as in reinforcing beams recessed into the bottom of the shelves. The mounting connectors extend into openings in the brackets. These openings are in alternate pairs to allow the shelf to be in either of two positions, preferably horizontal or tilted diagonally. The connectors have peripheral grooves configured to interengage with the plate type brackets, there being three such grooves so they can support one end of one shelf on a bracket or the adjacent ends of two shelves on a common bracket. Glass shelves can be mounted on these book end brackets using socket shelf mounts having a receiving socket in a body, an outer shelf support surface, and a resilient clip for attachment to the shelf.

14 Claims, 5 Drawing Sheets

BOOK END BRACKET AND SHELVING SYSTEM

BACKGROUND OF THE INVENTION

This invention relates to a shelving assembly employing vertical slotted standards and cantilever brackets attached thereto. These systems normally have each shelf resting on top of two or more brackets. Placing two shelves somewhat end-to-end requires at least four standards and four brackets in two spaced and separate side-by-side assemblies. It would be advantageous to have end-to-end shelves in one set, using a common bracket, and to have potential for different types of shelves, e.g., of wood, glass, etc. in the same set, mounted end-to-end in an aesthetically attractive arrangement. Moreover, it would be advantageous to enable one or more shelves to be optionally oriented in a slanted position for display of items or for standup activities such as reading or writing.

Cantilever shelving systems are usually mounted in garages, recreation rooms and the like, but not in living rooms, dining rooms and offices where the setting is more dressy. It would also be desirable, therefore, to have a cantilever shelving system with flexibility of arrangement and using hardware that is either not visible or is stylish, so as to be readily useable in such settings.

RELATED APPLICATIONS

This application is related to copending application Ser. No. 07/381,149, filed July 14, 1989, entitled AESTHETIC SHELVING SYSTEM Ser. No. 07/381,160, filed July 14, 1989, entitled SHELVING MOUNT SYSTEM; Ser. No. 07/381,148, filed July 14, 1989, entitled INTERLOCK SHELVING BRACKET AND STANDARD COVER; Ser. No. 07/381,108, filed July 14, 1989, entitled BEAM AND TELESCOPIC CONNECTOR SHELVING SYSTEM; and Ser. No. 07/381,150, filed July 14, 1989, entitled PIN AND CLIP SHELF MOUNTING.

SUMMARY OF THE INVENTION

The present invention provides a novel system of cantilever shelving with the shelves being suspended between brackets by telescopic connectors, preferably mounting pins, that slidably extend telescopically into openings at the ends of the shelves. Each pair of pins can suspend one end of one shelf or both adjacent ends of two end-to-end shelves, whether of wood, glass or other material, on brackets, wherein adjacent shelves can be optionally placed horizontally or on a diagonal slope for display. The brackets have pairs of openings at varying angular relationships, each pair being spaced apart an amount equal to the spacing of the telescopic connectors on the shelves. The interfit of the mounting pins with the brackets effects lateral stability by locking the shelf and brackets against side shift, and inhibits accidental tilting of the shelves with force on the front edge of the shelf.

These and other advantages and features of the invention will be apparent upon studying the following detailed description in conjunction with the drawings.

DESCRIPTION OF THE PREFERRED EMBODIMENTS

Figure 2:
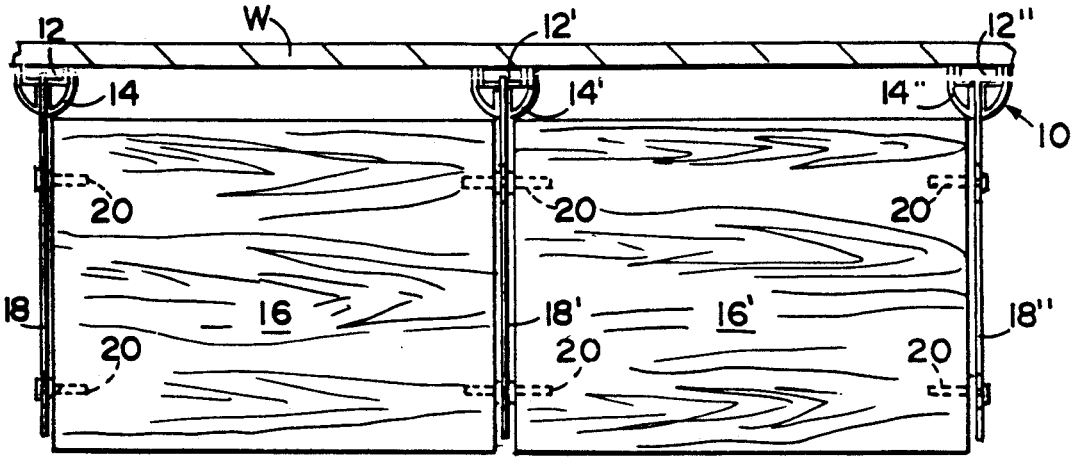
FIG. 2 is a top plan view of the assembly in FIG. 1.
Figure 1:
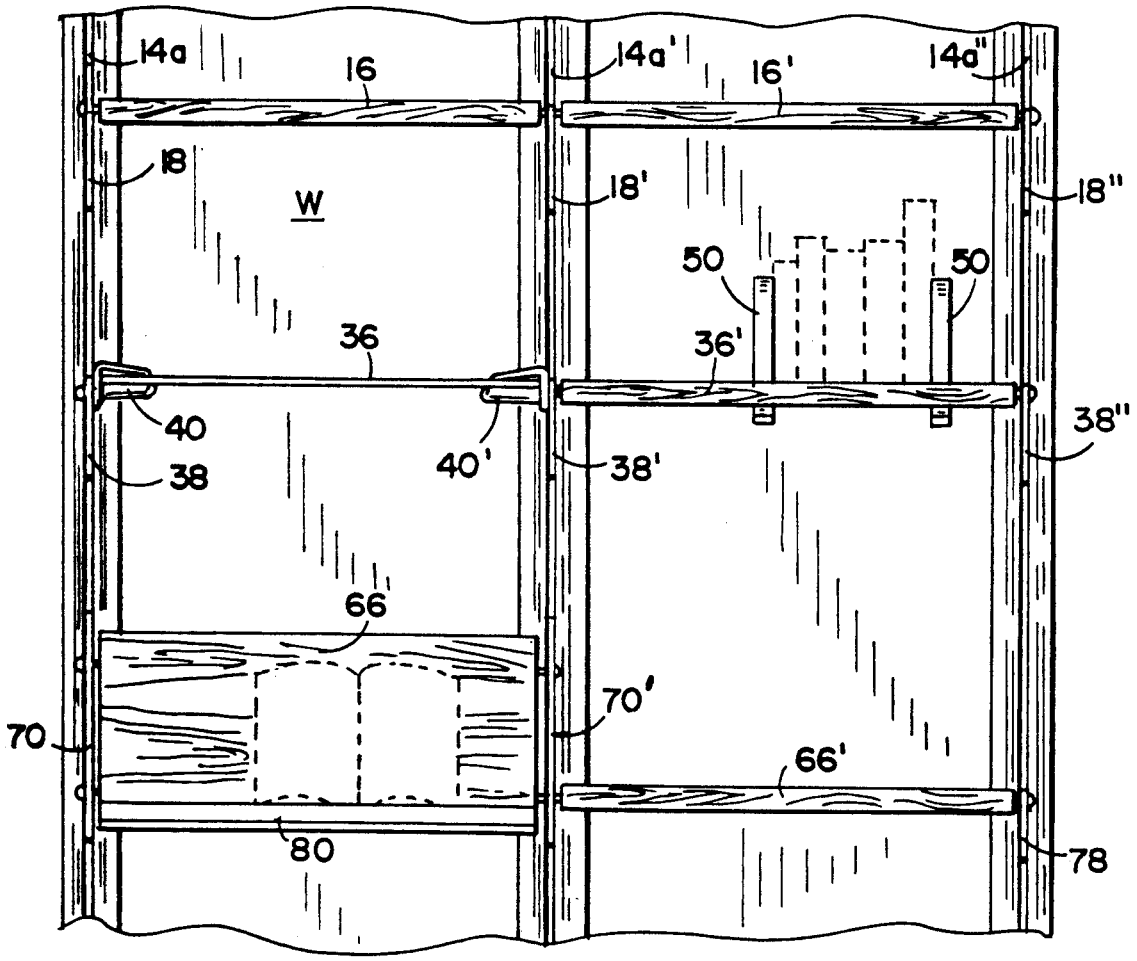
FIG. 1 is a front elevational view of a shelving assembly employing components of this invention.
Figure 11:
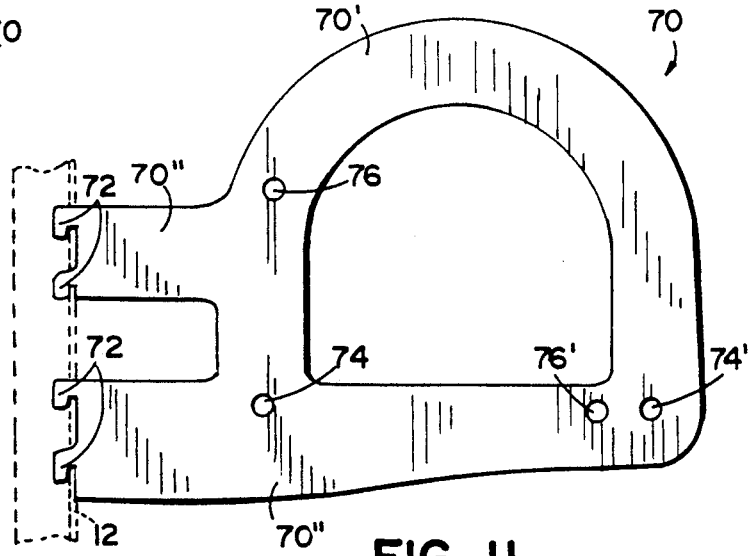
FIG. 11 is a side elevational view of a book end bracket for this invention.
Figure 27:
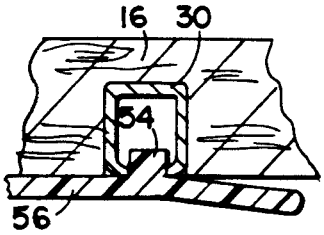
FIG. 27 is a greatly enlarged view of the interconnection of the bottom portion of the book end in FIG. 24 with the beam in the shelf.

Referring now specifically to FIGS. 1 and 2, there is disclosed a set of three vertical slotted standards mounted to the wall as by screws (not shown) in parallel relationship to each other, three sets of brackets, with three plate brackets in each set, one set at each standard, and telescopic connectors supporting three pairs of shelves on the brackets. The complete assembly 10 is shown mounted to wall W to support a variety of shelving units in a set. Only three standards are needed to support one pair or several pairs of shelves with each pair of end-to-end shelves requiring only three brackets. These shelves may be positioned in a variety of end-to-end arrangements in an attractive, finished assembly. The three vertical standards 12, 12' and 12'' are shown as basically U-shaped standards of conventional type, having a plurality of vertically elongated and vertically spaced slots with intermediate webs in its front face, shown in FIG. 2, in phantom in FIG. 11, and shown more specifically in copending application Ser. No. 07/381,149, filed July 14, 1989, entitled AESTHETIC SHELVING SYSTEM, incorporated by reference herein. The front face of each standard has these vertical slots for attachment of the cantilever brackets thereto. Spaced integral side faces of the standards have their rear edges abutting wall W.

Extending over the length of each vertical standard is a dress and stabilizing cover 14, 14' and 14'' respectively. This dress cover is preferably of the type taught in the above identified copending application. It includes a pair of legs which resiliently engage the side faces of the standards, and project forwardly in front of the standard an amount at least about the dimension of the standard thickness from its front face to the wall. Each of the dress covers includes an elongated vertical central space **14*a*, 14*a'* and 14*a''*** respectively, each space defined by a pair of flanges which engage the opposite side faces of brackets inserted through this space and through the standard slots into engagement with the standard webs with hook type lugs.

Figure 3:
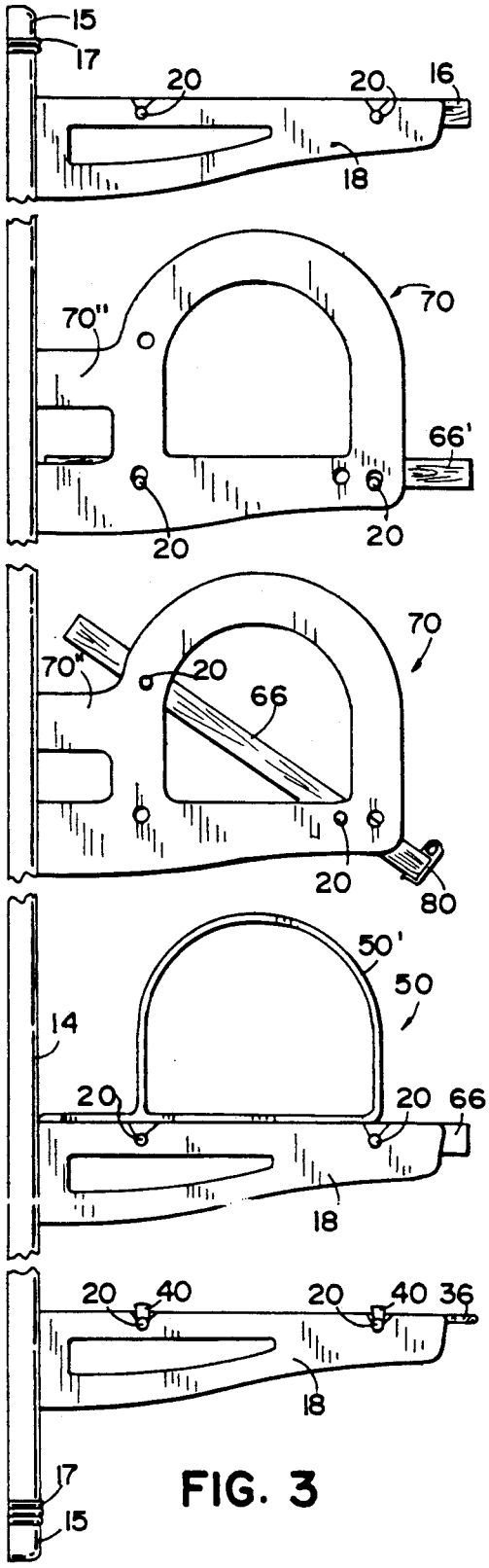
FIG. 3 is a side elevational view of a shelving assembly of somewhat differently arranged components than shown in FIGS. 1 and 2.
Figure 19:
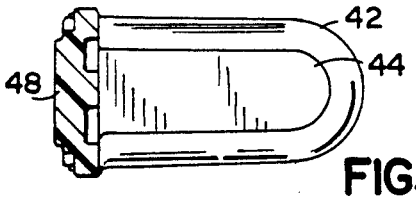
FIG. 19 is a sectional view taken on plane XIX—XIX of FIG. 15.
Figure 17:
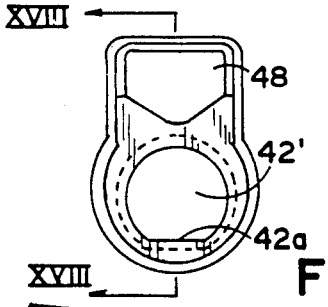
FIG. 17 is an end elevational view taken on plane XVII—XVII of FIG. 16.
Figure 18:
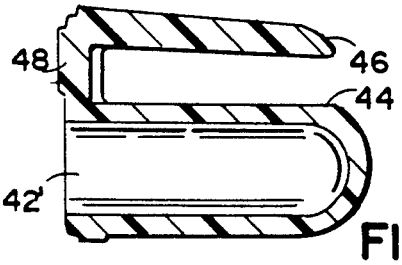
FIG. 18 is a sectional view taken on plane XVIII—XVIII of FIG. 17.
Figure 16:
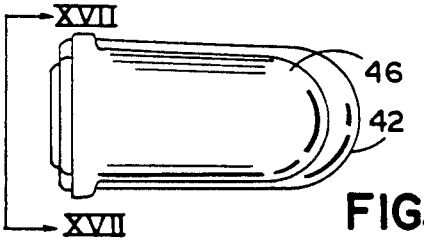
FIG. 16 is a top view of the connector socket shelf mount.
Figure 15:
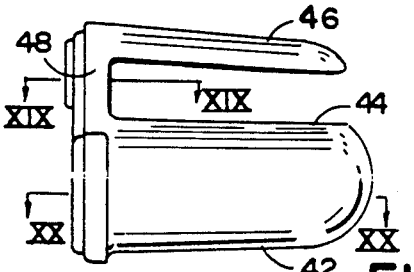
FIG. 15 is a side elevational view of a connector socket shelf mount.
Figure 20:
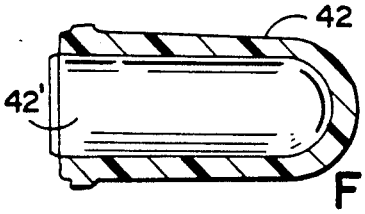
FIG. 20 is a sectional view taken on plane XX—XX of FIG. 15.
Figure 10:
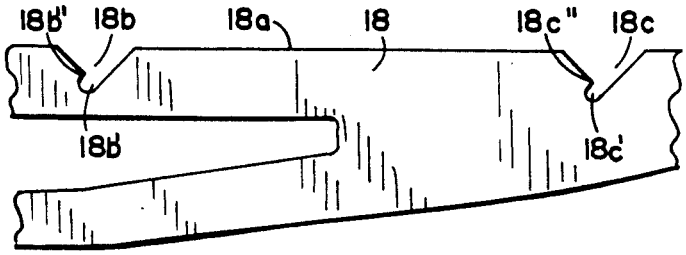
FIG. 10 is a fragmentary enlarged view of a portion of one of the cantilever brackets.

The top pair of shelves 16 and 16' are supported on three plate brackets 18, 18' and 18''. The top three brackets in the assembly in FIG. 1 are of the type shown at the top of FIG. 3. On the brackets of this type, there is at least a pair of lugs which extend rearwardly and downwardly from one end thereof comparable to the lower set of lugs on the bookcase bracket depicted in FIG. 11. For purposes of clarity, and to illustrate the versatility of the present invention, FIG. 3 shows a slightly different arrangement of shelving brackets and shelves than FIG. 1. Brackets 18, 18' and 18'' have an upper surface configuration like that depicted in FIG. 10. More specifically, in at least two areas of this plate type metal bracket, the upper surface **18*a* has special recesses 18*b* and 18*c* which are generally V-shaped in configuration but preferably have an undercut area at 18*b'* and 18*c'* sloping downwardly inwardly toward the end that is secured to the standard, i.e., the end with the lugs thereon, to form overhanging retention lips 18*b''* and 18*c''***. The purpose of these lips will be explained hereinafter. Thus, the generally V-shaped pockets or recesses can be considered more specifically as having a y-shape. These pockets are spaced from each other an amount equal to the spacing of the openings and cooperative telescopic connectors on the shelves to be described hereinafter.

Figure 6:
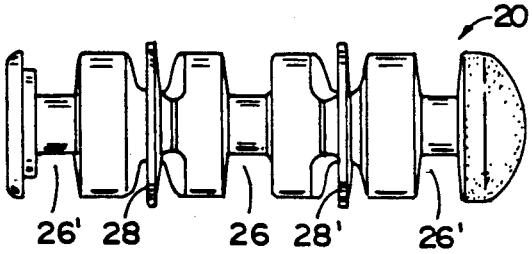
FIG. 6 is a greatly enlarged elevational view of a preferred form of telescopic connector pin of this invention.
Figure 7:
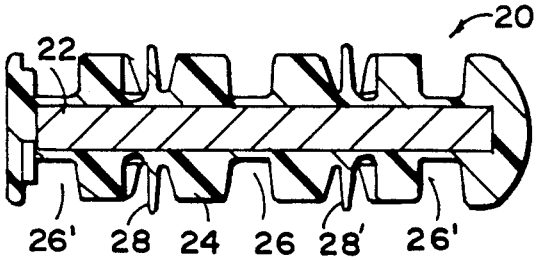
FIG. 7 is a longitudinal sectional view through the pin in FIG. 6.

Interconnecting the left end of shelf 16 with end bracket 18, the right end of shelf 16' with end bracket 18'', and the adjacent right end of shelf 16 and left end of shelf 16' with the middle or intermediate bracket 18', are a plurality of like telescopic connectors 20 preferably of the type depicted in FIGS. 6 and 7. Optionally the type depicted in FIG. 8 or the equivalent can be employed. Each telescopic connector is preferably, therefore, a specially configurated pin which has an elongated cylindrical steel core 22 surrounded by an integral polymeric jacket 24. This polymeric jacket includes a central annular cavity 26 of sufficient width to receive and interfit with one of the plate type brackets, and a pair of annular cavities 26' toward the ends of the connector to optionally receive and interfit with a bracket in the manner to be explained hereinafter. Protruding circumferentially from both end portions of the body are resilient polymeric flexible annular fins 28 and 28', respectively. It will be noted that these fins protrude circumferentially further than the remaining body of the connector. The body is of a diameter just smaller than the orifice or opening into which it telescopically fits to readily slide into a desired position. The protruding fins peripherally engage the walls of the opening to be deformed thereby, for frictional retention characteristics. In the illustrative drawings, the right end of this telescopic connector is shown to be convexly rounded whereas the left end is shown to be flat. This is an optional feature. The flat end takes less space and allows another component to be placed closely thereto. These telescopic connectors interfit with orifices or openings in the ends of a shelf, such as reinforcing beams of a wood shelf, or in separate support socket mounts 42 of the type in FIGS. 15–20 and preferably used with glass shelves. The connectors can interconnect with either the type of bracket depicted at 18 (FIG. 3) or the special book end bracket in FIG. 11, as will be explained.

Figure 9:
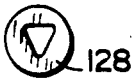
FIG. 9 is an enlarged elevational view of a polymeric ring forming part of the alternative embodiment in FIG. 8.
Figure 8:
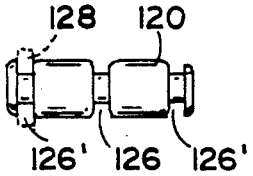
FIG. 8 is an elevational view of an alternative embodiment of connector pin.

An alternative telescopic pin connector is depicted in FIGS. 8 and 9. It includes a main body 120, preferably of steel, having a plurality of three annular grooves around its periphery, such grooves being 126 in the center thereof and 126' at the ends thereof. Any one of these three grooves is of a width slightly greater than the width of the plate brackets to receive and interengage with the brackets. Also, for a friction fit within the openings, i.e., in the beams 30 or in the socket mount 42, resilient rings 128 as of rubber are placed in the selected groove or grooves. These rings as depicted more specifically in FIG. 9, preferably have a circular outer configuration and a polygonal, e.g., triangular, internal opening. Alternatively a simple conventional O-ring may be employed for this purpose. Thus in the illustrative embodiment of FIG. 8, ring 128 is placed in the left hand groove to be inserted into a cavity. Either of the other two grooves can be employed to interengage a bracket.

Figure 4:
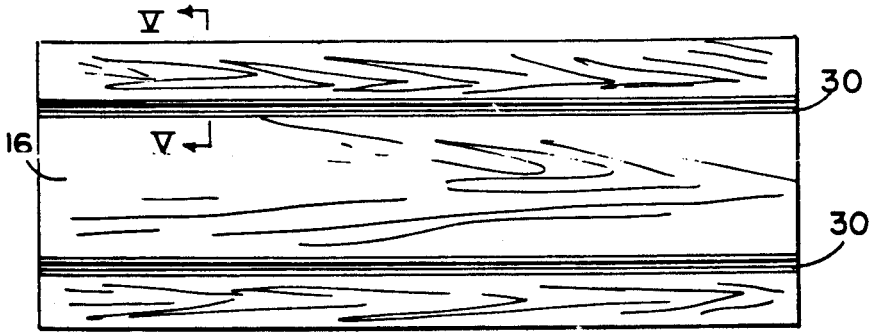
FIG. 4 is a bottom view of a wood shelf of this invention.
Figure 5:
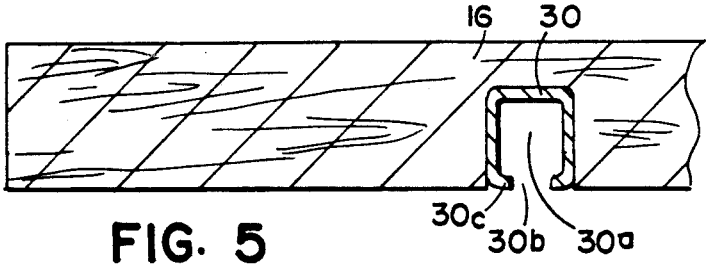
FIG. 5 is a fragmentary sectional enlarged view of a portion of the shelf in FIG. 4 taken on plane V—V.

Shelves 16 and 16' are preferably of wood material and may be of pressed wood rather than finished lumber. Each of these shelves, as in FIGS. 4 and 5, is shown to include a pair of parallel elongated reinforcing beams 30 spaced from each other, extending lengthwise of the shelf, and recessed into a groove in the bottom of the shelf (FIG. 5). Each beam preferably comprises a tubular type member having an internal hollow area **30*a* and an elongated slot-like opening 30*b* at the bottom thereof straddled by a pair of edge flanges 30*c*. The peripheral configuration is preferably generally rectangular as depicted, although other configurations may be employed. This beam is open on its ends to form orifices, i.e. openings into which the telescopic connectors are inserted. More specifically, the generally cylindrical telescopic connector 20 has one end inserted into one end of a respective beam, with fin 28 being slightly larger in its diameter than the internal diameter or width of space 30*a* so that the fin is flexed back resiliently when the connector is inserted. This provides a frictional fit. The amount which the connector is inserted is determined by whether the connector is to be used to support one end of one shelf or two ends of two adjacent end-to-end shelves. Thus, to support the left end of shelf 16 and the right end of shelf 16', two connectors are inserted into the respective shelf about two-thirds of the length of the connector, so that end groove 26' will interengage with the bracket by receiving the plate bracket. However, the opposite ends of the central pair of connectors for the right end of shelf 16 and the left end of shelf 16' are inserted only about one-half of the way into each of these two shelves, so that the central groove 26 of each connector pin interengages with a common bracket 18' by receiving it. The telescopic connectors are interfitted with the recesses 18*b* and 18*c* (FIG. 10) of the brackets, and particularly the undercut portion 18*c*' thereof. The overlying lips 18*b*'' and 18*c*''** prevent the pins and thus the rear portion of the shelves from inadvertently being dislodged upwardly by downward vertical pressure on the front of the shelves. Likewise, the lips at the front recesses on the brackets prevent the shelves from being inadvertently dislodged by upward vertical force on the outer edge of the shelves.

Figure 21:
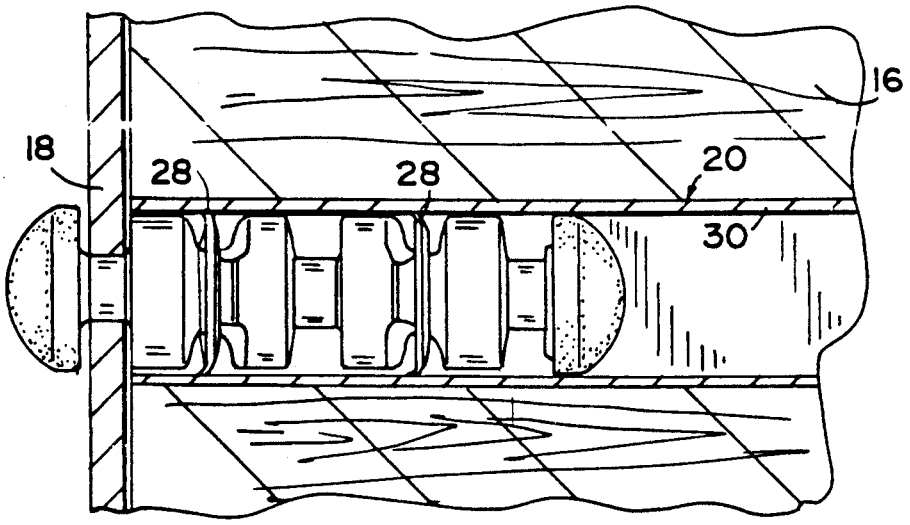
FIG. 21 is a greatly enlarged sectional horizontal view of the connection between one bracket and one end of a wood shelf.
Figure 22:
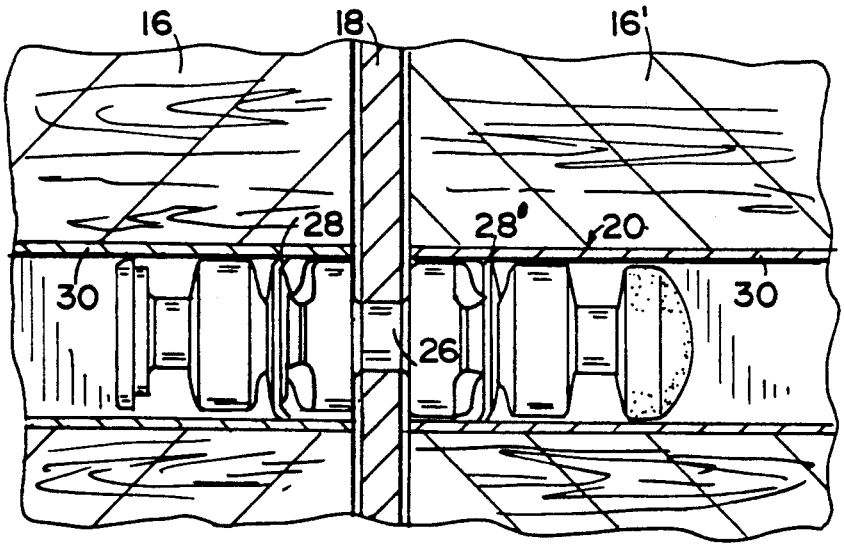
FIG. 22 is a greatly enlarged horizontal sectional view of one bracket and the adjacent ends of two wood shelves connected thereto.

FIGS. 21 and 22 show the connections enlarged to assure complete understanding of this assembly operation. In FIG. 21 is depicted the left end of shelf 16 with connector 20 and bracket 18. In FIG. 22 is an enlarged view of shelves 16, 16', connector 20 and bracket 18'. The shelves are astraddle this central bracket. These can be put together in various combinations in the set.

Particularly, in FIG. 1, the central pair of shelves illustrate how a glass shelf can be mounted side-by-side with, and at the same level as, a wood shelf, utilizing just three brackets and three standards. More specifically, wood shelf 36' is basically like shelf 16' thereabove and shown end-to-end with glass shelf 36, both mounted on three brackets 38, 38' and 38'' which are like brackets 18, 18' and 18'' thereabove. Glass shelf 36 is supported on two pairs of socket mounts 40 and 40' which are alike except in mirror image position.

Each of these socket mounts preferably comprises an integral polymeric structure composed of a main elongated body 42 (FIG. 15) defining an internal socket 42' (FIG. 18) and having an opening on one end to receive the telescopic connector pin. Preferably, this opening is generally cylindrical with a diameter substantially the same as the diameter of a fin, e.g. 28 on pin connector, but also including a chordal flat **42*a* to bend a portion of the resilient fin for creating a friction fit. If desired, this chordal flat need not be used, but the diameter of cavity 42' made slightly smaller than the diameter of the fin. However, it has been determined upon testing that, in such an instance, it is difficult at times to flex the fin into the opposite direction after insertion, thereby rendering removal difficult. On the upper surface of body 42 is a shelf support surface 44 parallel to the socket axis, and upon which the glass shelf rests. Generally parallel to this surface, but sloped slightly theretowards, and spaced therefrom, is a resilient clip formed of a first leg 46 joined at one end thereof by a second leg 48 to body 42. Leg 48 is at the end where the opening to cavity 42' is located. Because the outer free end of leg 46 is slightly closer to support surface 44 than the thickness of the shelf to be inserted, this leg must be deflected away from the body a small amount, against its inherent bias, when the shelf is inserted, thereby subsequently applying a resilient biasing pressure against the shelf to retain it against support surface 44. Thus, by inserting shelf 36 into the clips of the respective connectors 40 and 40', and then inserting the telescopic connector pins 20 into the outer ends of sockets 42', the shelf can be securely mounted on brackets 38 and 38'. In FIG. 1 as depicted, connector pin 20 is inserted about two-thirds of its length into the socket so that the outer exposed end has its groove 26' engaging with bracket 38. However, the connector pin for mount 40' is inserted approximately one-half of its length into the socket so that central groove 26 receives bracket 38', and the other end of connector 20 is inserted about one-half of its length into the opening of beam 30 for wood shelf 36'. The opposite end of shelf 36' is supported in the same fashion as shelf 16'** thereabove.

Figure 23:
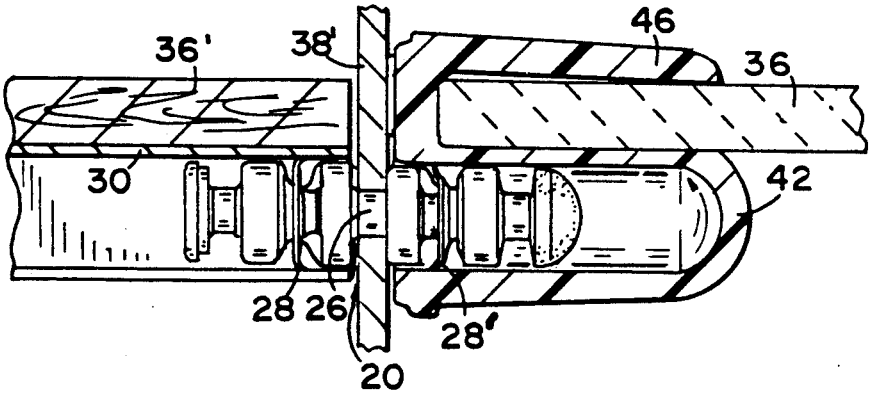
FIG. 23 is an enlarged sectional elevational view of one bracket, one end of a wood shelf on one side thereof and a connector socket mount and glass shelf on the other side thereof.
Figure 24:
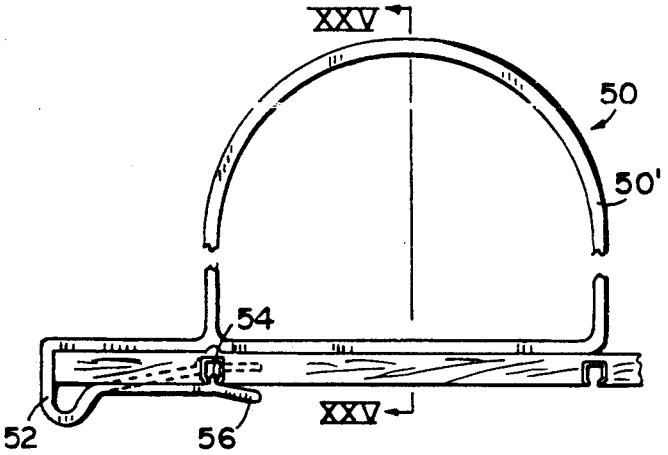
FIG. 24 is an elevational view of a wood shelf with a book end support attached thereto.
Figure 25:
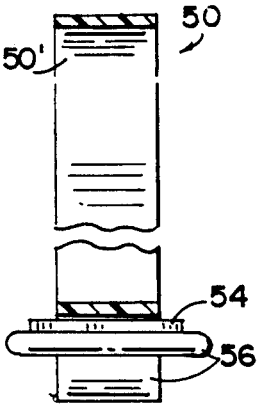
FIG. 25 is a sectional elevational view taken on plane XXV—XXV of FIG. 24 but with the shelf removed.
Figure 26:
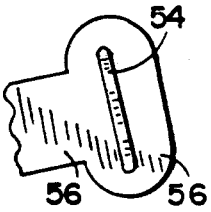
FIG. 26 is an enlarged fragmentary view of a bottom portion of the book end support in FIG. 24.
Figure 12:
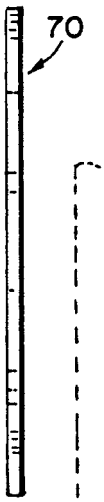
FIG. 12 is an end elevational view of the book end bracket in FIG. 11.

FIG. 23 illustrates the details of a glass shelf with its socket mount, a wood shelf with a support beam and mounted end-to-end to the glass shelf, and common bracket therebetween. This is comparable to the middle pair of shelves in FIG. 1, but with the position of the two shelves reversed.

Shelves 36 and 36' are supported in such fashion with the common mounting pins that their upper surfaces are substantially coplanar. The two adjacent ends of the shelf, therefore, are not only immediately adjacent each other, but also are aligned with each other.

Also positioned on shelf 36' (FIG. 1) is a pair of book end supports 50 of the type shown in FIGS. 24–27 and also shown as the second from the bottom arrangement in FIG. 3. This book end support is shown to include a flat member configurated into an inverted generally U-shaped loop to form an upright retainer 50'. It also has a lower resilient U clip 52 which extends around the edge of a shelf, here shown to be the rear edge. This clip has a leg 56 under the shelf, resiliently biased toward the main body portion of the book end support. The unit depicted is a modified book end from that illustrated in U.S. Pat. No. 4,327,838. That is, leg 56 has a key or protrusion 54 on its upper surface, of a width slightly less than opening slot **30*b* (FIG. 5) in the bottom of the shelf beam, to fit therein. This elongated key 54 stabilizes the book end support against twisting on the shelf. Hence, upon installation, leg 56 is deflected from its at rest position shown in dotted lines in FIG. 24, against its inherent bias, to its extended installed position, and then snapped into position with key 54 in slot 30*b*** as shown in solid lines.

The bottom pair of end-to-end shelves in FIG. 1 illustrates the capacity of having one shelf 66 in a tilted display position and the adjacent shelf 66' in a horizontal orientation. Shelf 66 is shown mounted on two specially configurated book end brackets 70 of the type in FIGS. 3, 10, 11 and 12. These book end brackets are formed of plate stock like the other brackets, but are configurated differently such that there is an upstanding, inverted, generally U-shaped portion and an integral, lower, horizontal base portion 70'' terminating at the rear edge thereof (FIG. 11) in a pair of hook type lugs 72 to engage with the front panel of a slotted standard 12 shown in dotted lines. These lugs extend rearwardly and downwardly and are preferably of the type set forth in the above identified copending application, to engage behind webs between the slots of the standard. Also protruding rearwardly from upstanding portion 70' is a rear extension 70'' parallel to the base of the book end bracket and having another pair of lugs 72' thereon for engaging another pair of slots in standard 12.

This book end bracket is shown to have two pairs of openings, the openings in each pair being spaced an equal distance apart. Specifically, openings 74 and 74' in the first pair are spaced a distance from each other equal to the spacing of the openings and telescopic connectors on the ends of the shelves. Opening 74 is intermediate the ends of the base of book end bracket 70 and opening 74' is out toward the outer edge thereof. A second pair of openings 76 and 76' are on a diagonal plane relative to each other, sloping downwardly and outwardly. They are spaced apart a distance equal to the distance between openings 74 and 74'. Conceivably openings 74' and 76' could be the same opening, either of this same size or enlarged, to cooperate with the other openings 74 and 76. The purpose of these openings is to receive the ends of the telescopic connector pins 20 in a manner that the annular groove on the pins receives the bracket portion at the bottom of the bracket opening, to interconnect. The diameter of the circular openings is slightly larger than the circular ends of the connector pins to be able to receive such and thereafter interengage at the lower edge of openings 74 etc. with the selected annular groove 26 or 26' of the connector pin 20.

Of the two shelves at the bottom of FIG. 1, the shelf at the left, i.e., 66, is shown slanted for a display arrangement as is the middle shelf depicted in FIG. 3. At the right side of the bottom of FIG. 1, shelf 66' is shown in the horizontal arrangement. This is also depicted second from the top in FIG. 3. The left slanted shelf 66 in FIG. 1 is supported on a pair of the special book end brackets 70 and 70', while the right horizontal shelf 66' is supported on the left side by book end bracket 70' and on the right side by a bracket 78 comparable to bracket 18. The sloped shelf 66 has a pair of telescopic pin connectors 20 engaged in openings 76 and 76'. Shelf 66' has its pin connectors 20 in the two horizontal openings 74 and 74' at the centrally placed book end bracket 70'.

Figure 13:
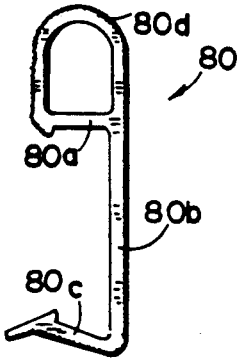
FIG. 13 is an enlarged end elevational view of a shelf lip for this invention.
Figure 14:
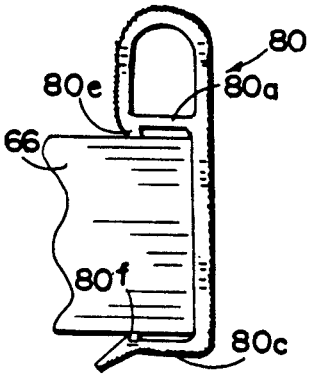
FIG. 14 is an end elevational view of the shelf lip in FIG. 13 as attached to the edge of a shelf.

A retention lip 80 is employed on the lower outer edge of sloped shelf 66 to prevent articles from falling off the shelf. This retention lip 80 (FIG. 1 at the lower left, FIG. 3 in the center, and shown in greater detail in FIGS. 13 and 14) is an elongated element, preferably extruded of a polymeric material. An upstanding, generally U-shaped inverted retainer **80*d* protrudes above the edge of the shelf. An upper leg 80*a* engages the upper edge of the shelf, a vertical face 80*b* engages the front edge of the shelf, and a lower resilient leg 80*c* is integrally attached to the bottom of face 80*b* to engage the bottom edge of the shelf. In the free form of this unit 80, lower leg 80*c* is at an upwardly rearwardly oriented angle relative to leg 80*a*, but is resiliently deflectable away to a generally horizontal orientation parallel to leg 80*a* as shown in FIG. 14 when installed on the shelf. Thus, by pulling down on the lower edge and inserting shelf 66, the retention lip is resiliently gripped onto the front edge of the shelf. This gripping action is aided by the downwardly protruding elongated tooth 80*e* on leg 80*a*, and the upwardly engaging elongated tooth 80*f* on lower leg 80*c*. This member is shown to have an elongated ribbed surface on its exterior for decorative purposes. Obviously this could be smooth or of other surface configurations. Likewise, cover 14 previously described and the end caps 15 could have various decorative surface configurations as best suits the environment in which the apparatus is being installed. Similarly, a plurality of two decorative collars 17 are shown at the top in FIG. 3, and three such collars 17** at the bottom, for merely illustrative purposes. No collars need be used or a selected number inserted all as explained in the above identified copending application.

From the illustrative embodiments depicted, it is apparent that a variety of shelving configurations of attractive nature can be readily assembled as desired for the particular use involved. Utilizing three standards and three brackets, any pair of shelves can be mounted end-to-end. If it is desired to have more end-to-end shelves, four or more standards could be employed. These shelves can be of wood, plastic or some other material having the end orifices receiving the telescopic connectors. The shelving is secure against vertical displacement by an inadvertent force applied thereto. It is also stable against lateral movement. The assembly is aesthetically appealing with practically no hardware visible. Hence, it can be employed in offices, in living rooms and in other areas, rather than just in garages, recreation rooms and the like where prior slotted standard hardware is typically found. Its assembly is simple, allowing customers with no particular mechanical experience or aptitude to readily assemble desired components in the final needed configurations.

Those skilled in this art, when studying this disclosure, will readily see additional advantages to those specifically recited above. A variety of alterations could conceivably be applied to the preferred embodiments depicted, to suit a particular situation, and without departing from the unique concept presented. Hence, the invention is not intended to be limited to the specific preferred illustrative embodiments, but only by the scope of the appended claims and the reasonably equivalent structures to those defined therein.

The embodiments of the invention in which an exclusive property or privilege is claimed are defined as follows.

1. A shelf assembly capable of having the shelf in a flat position or a tilted display position, comprising:

a pair of vertical slotted standards for mounting to a wall in spaced relationship;

at least one pair of cantilever brackets, each having lugs on one end for engagement in said slotted standards, and each having means forming two pairs of connector receiving openings therein, the openings of each pair being the seam distance apart, one pair being in a horizontal plane to hold a shelf in horizontal position and the other pair being in a diagonal plane to hold a shelf in a diagonal position; and a shelf having a pair of mounting connectors at the ends thereof, said connectors being of dimensions to be received by either of said alternate pairs of openings and being spaced apart the same distance as said openings in said pairs, for alternate mounting of said shelf in horizontal or tilted diagonal orientation;

said shelf having reinforcing beams recessed into the underside thereof, said beams having channels therein, and said connectors being telescopically slidably received in said channels; and said connectors are mounting pins having flexible peripheral projections causing a friction fit in said channels.

2. A shelf assembly capable of having the shelf in a flat position or a tilted display position, comprising:

a pair of vertical slotted standards for mounting to a wall in spaced relationship;

at least one pair of cantilever brackets, each having lugs on one end for engagement in said slotted standards, and each having means forming two pairs of connector receiving openings therein, the openings of each pair being the same distance apart, one pair being in a horizontal plane to hold a shelf in horizontal position and the other pair being in a diagonal plane to hold a shelf in a diagonal position; and a shelf having a pair of mounting connectors at the ends thereof, said connectors being of dimensions to be received by either of said alternate pairs of openings and being spaced apart the same distance as said openings in said pairs, for alternate mounting of said shelf in horizontal or tilted diagonal orientation;

said shelf having reinforcing beams recessed into the underside thereof, said beams having channels therein, and said connectors being telescopically slidably received in said channels;

said connectors are mounting pins having flexible peripheral projections causing a friction fit in said channels; and said mounting pins have portions projecting from said channels and have peripheral portions on said projecting portions configurated to interengage with said brackets.

3. The shelf assembly in claim 2 wherein said mounting pins have such configurated peripheral portions centrally thereof enabling two shelves to be mounted end-to-end astraddle one of said brackets.

4. The shelf assembly in claim 2 including a third slotted standard, a third bracket, and a second shelf;

said shelves being arranged end to end and said brackets being in parallel relationship, the first and second brackets being at the outer end of the respective shelves and the third one being between the two shelves;

said shelves having inner ends adjacent to each other and astraddle said third bracket;

said mounting pins at the outer ends of said shelves having one end in said channels and configurated peripheral portions at the other end thereof engaging said first and second brackets respectively, and said mounting pins at said adjacent inner ends of said shelves having their two ends received by channels in both of said shelves and having configurated portions interengaging said third bracket intermediate the ends of said mounting pins, whereby the two shelves are mounted on three brackets.

5. The shelf assembly in claim 4 wherein said peripheral projections are fins.

6. The shelf assembly in claim 5 wherein said pins comprise a steel core covered by a polymeric jacket, said fins being integral with said jacket.

7. A shelf assembly for mounting on slotted vertical standards having vertically spaced elongated slots and intermediate webs, comprising:

a pair of cantilever brackets;

each said bracket being a plate-type member having an elongated base, said base having an outer end and a rear end;

an upstanding panel from and integral with said base;

said base having lug means extending from said rear end for insertion through standard slots to engage with standard webs;

said panel having a rearward extension spaced above said base;

said extension having lug means extending therefrom for insertion through standard slots to engage with standard webs;

said brackets having openings to receive shelf mounts;

a shelf between said brackets;

shelf connectors between the ends of said shelf and said brackets to suspend said shelf on said brackets;

said shelf connectors comprising shelf mounting pins;

said bracket openings being shaped to receive said shelf mount pins; and said pins having grooves in the periphery thereof for receiving portions of said bracket defining said openings.

8. The shelf assembly in claim 7 wherein there are at least two of said pins on each end of said shelf spaced from each other a predetermined amount;

said brackets each have at least two pairs of said openings, each pair being spaced apart an amount comparable to the spacing of said pins, whereby said shelf can be mounted in at least two locations.

9. The shelf assembly in claim 8 wherein one of said pairs of openings is at an angle to the horizontal.

10. A shelf assembly for mounting on slotted vertical standards having vertically spaced elongated slots and intermediate webs, comprising:

a pair of cantilever brackets;

each said bracket being a plate-type member having an elongated base, said base having an outer end and a rear end;

an upstanding panel from and integral with said base;

said base having lug means extending from said rear end for insertion through standard slots to engage with standard webs;

said panel having a rearward extension spaced above said base;

said extension having lug means extending therefrom for insertion through standard slots to engage with standard webs;

said brackets having openings to receive shelf mounts;

a shelf between said brackets;

shelf connectors between the ends of said shelf and said brackets to suspend said shelf on said brackets;

pin socket shelf mounts for mounting the ends of said shelf on said brackets;

said mounts comprising a body having a socket to receive and interengage mounting pins, and a clip receiving the ends of said shelf; and said shelf connectors comprising mounting pins slidably fit in said sockets of respective mounts and having portions protruding from said sockets, said portions being configurated to interengage said brackets.

11. The assembly in claim 10 wherein said sockets are elongated and frictionally receive said mounting pins therein; and said shelf mounts include an outer shelf support surface spaced from said socket, and have one leg of said clip spaced from and generally parallel to said support surface.

12. The shelf assembly in claim 11 wherein said clip includes a second leg integrally joining said one leg with said body, and said one leg being resiliently biased toward said support surface for retention of a shelf therebetween.

13. The shelf assembly in claim 12 wherein said mounts including said body and said clip are each an integral polymeric structure.

14. The shelf assembly in claim 10 wherein said pins comprise a steel core and a polymeric jacket, said jacket including at least one flexible peripheral fin to frictionally interfit with said socket.

* * * * *